US005180010A

United States Patent [19]

Stout et al.

[11] Patent Number: 5,180,010

[45] Date of Patent: Jan. 19, 1993

[54] MULTIPLE ACTING LOCK FOR GRAVEL PACK SYSTEM

[75] Inventors: Gregg W. Stout, Montgomery, Tex.; James T. Matte, Broussard, La.

[73] Assignee: The Western Company of North America, Houston, Tex.

[21] Appl. No.: 736,389

[22] Filed: Jul. 26, 1991

[51] Int. Cl.[5] ..... E21B 23/04

[52] U.S. Cl. ..... 166/212; 166/217; 166/237

[58] Field of Search ..... 166/51, 120, 187, 322, 166/212

[56] References Cited

U.S. PATENT DOCUMENTS

| | | | |
|---|---|---|---|
| 2,713,910 | 7/1955 | Baker et al. . | |
| 3,678,998 | 7/1972 | Cockrell et al. . | |
| 3,987,854 | 10/1976 | Callihan et al. . | |
| 4,049,055 | 9/1977 | Brown . | |
| 4,180,132 | 12/1979 | Young . | |
| 4,253,522 | 3/1981 | Setterberg, Jr. . | |
| 4,401,158 | 8/1983 | Spencer et al. . | |
| 4,451,486 | 9/1985 | Wetzel et al. . | |
| 4,479,539 | 10/1984 | Tamplen et al. | 166/212 |
| 4,516,634 | 5/1985 | Pitts | 166/212 X |
| 4,519,451 | 5/1985 | Gray et al. . | |
| 4,522,264 | 6/1985 | McNeer . | |
| 4,540,051 | 9/1985 | Schmuck . | |
| 4,541,484 | 9/1985 | Salerni et al. . | |
| 4,566,538 | 1/1986 | Peterson . | |
| 4,606,408 | 8/1986 | Zunkel . | |
| 4,611,658 | 9/1986 | Salerni et al. . | |
| 4,627,488 | 12/1986 | Szarka . | |
| 4,658,895 | 4/1987 | Brisco . | |
| 4,664,188 | 5/1987 | Zunkel et al. . | |
| 4,700,777 | 10/1987 | Luers . | |
| 4,726,419 | 2/1988 | Zunkel . | |
| 4,772,392 | 2/1988 | Proctor et al. . | |
| 4,834,175 | 5/1989 | Ross et al. . | |
| 4,858,690 | 8/1989 | Rebardi et al. . | |
| 4,871,018 | 10/1989 | Caskey et al. . | |
| 4,995,456 | 2/1991 | Cornette et al. . | |

*Primary Examiner*—Thuy M. Bui
*Assistant Examiner*—Frank S. Tsay
*Attorney, Agent, or Firm*—Peter A. Bielinski

[57] ABSTRACT

A multiple acting lock is provided which prevents premature setting of the packer of a gravel pack tool by the setting piston of a setting tool. The lock comprises a locking cylinder which when in the locked position rotationally locks the setting tool with the gravel pack tool thereby allowing rotation of the tool during tripping to facilitate working the tool past tight spots. The lock also longitudinally locks the setting sleeve of the gravel pack tool to prevent premature setting of the packer of the gravel pack tool. The locking mechanism of the setting sleeve comprises keys located in keyholes and a sleeve inside the setting sleeve which protrude and engage with the setting sleeve. The locking cylinder when in a locked position covers the inside of the keyholes retaining the keys in engagement with the setting sleeve. When the locking cylinder is hydraulically moved to the unlocked position the keys slide inward out of the keyholes and out of engagement with the setting sleeve.

23 Claims, 3 Drawing Sheets

MULTIPLE ACTING LOCK FOR GRAVEL PACK SYSTEM

TECHNICAL FIELD OF THE INVENTION

This invention relates to a gravel pack system, and, in particular, to a multiple acting lock for such a system which allows rotation of the entire system while it is tripped down a well hole and prevents premature setting of the system in the casing during tripping.

BACKGROUND OF THE INVENTION

After a well hole has been drilled and a casing has been cemented in place lining the well hole, various tools are "tripped", or lowered, down the cased hole to perform various functions in the well hole. While the tools perform their function they often need to be secured inside the casing at a certain point. An example of such a tool is a gravel pack tool which is used to provide a screen to filter out sand from oil being produced from a formation. When oil flows from certain formations into the casing, sand can slough off from the formation and travel with the oil into the casing, this causes premature wearing and damaging of oil field production equipment. Gravel packing tools have been developed to pack gravel around a screen disposed in the well hole proximate the producing formation. This packed gravel prevents the sand in the producing formation from traveling with the oil into the well hole casing.

A gravel pack tool is "tripped" down the hole on a service tool assembly. The gravel pack tool and the service tool assembly together are referred to as a gravel pack system. The service tool assembly typically comprises a cross-over tool, which is used in depositing the gravel slurry around the screen, and a setting tool, which is used to set the gravel pack tool inside the casing. The gravel pack tool is typically connected to the service tool assembly by either a left-hand square thread or some type of shearing device which shears upon a pulling up of the work string.

After the gravel pack tool has been lowered to the desired position proximate a producing zone, the setting tool is activated to set the gravel pack tool inside the casing. Also, the producing zone proximate the gravel pack tool must be isolated from the remainder of the cased hole. This setting and isolation is achieved by setting packers above and below the gravel screen of the gravel pack tool. The bottom packer is typically tripped down the hole before the gravel pack tool and set into the casing. This bottom packer is commonly referred to as a sump packer. A typical packer has an elastomeric circular ring which is radially extended to seal circumferentially with the inside of the casing. Packers also have a teeth element that bites into the side wall of the casing to 10 prevent any movement of the packer in the casing. The sump packer seals the well hole below the gravel pack tool so no oil being produced travels down the well hole. After the sump packer is in place, the gravel pack tool is tripped down the hole until the bottom of the gravel pack tool engages and seals inside the sump packer.

The top packer is typically a part of the top of the gravel pack tool and is generally referred to as the gravel pack packer. The gravel pack packer is maintained in an unset position during "tripping" and then set into the casing by the setting tool of the service tool assembly when the gravel pack tool has been properly bottomed in the sump packer. Located immediately above the gravel pack packer and also on the gravel pack tool is a setting sleeve. The setting tool of the service tool assembly, typically upon hydraulic activation, engages with the setting sleeve which in turn pushes on the packer, setting the packer into the casing.

In crooked wells, highly deviated wells, horizontal wells, or wells with stepped casing, a tool being tripped down the well will often bind inside the casing at a sharp radius or an edge of stepped casing. In such a situation it is necessary to manipulate the work string back and forth and/or in a rotational manner to work the tool by the "tight spot". A danger in working a tool by a tight spot is that the setting sleeve above the packer could catch on the casing while the work string moves upward relative to the setting sleeve. Such movement can cause the sleeve to push on the packer thus prematurely setting the packer inside the casing. Premature setting of the packer jams the gravel pack tool in the casing out of position. Retrieving such a jammed tool is costly and time consuming. While the typical safety mechanism to prevent such a premature setting is the use of shear s crews in the setting sleeve, the shear screws can still be overcome by such manipulations through tight spots. Casing liner tops in horizontal wells can be particularly difficult to pass since tools tend to ride on the bottom side of the casing. Thus, a need exists to provide a mechanical lock on the setting sleeve to prevent premature setting of the gravel pack packer.

Such a lock should also be easily deactivated when it is desired to set the gravel pack packer. Manipulation of the work string to disengage the lock is undesirable because manipulation of the work string will be used to work the gravel pack tool past tight spots. Thus, a need exists to deactivate the lock without having to manipulate the work string.

Since work string rotation may be required to work tools by tight spots, there must be a rotational lock mechanism to transmit work string rotation to the gravel pack tool. But since the gravel pack tool is often connected to the service tool assembly with a left-hand square thread the rotational lock mechanism must be easily deactivated to enable the rotation of the service tool assembly out of engagement with the gravel pack tool. Again, manipulation of the work string would be an undesirable way to disengage a rotational lock thus a need exists for a rotational lock which can be hydraulically deactivated.

It would be preferable that one locking mechanism could both rotationally lock the gravel pack tool and lock the setting sleeve.

When the service tool assembly is rotated to disconnect from the gravel pack tool at the left-hand square thread, it is recommended that the string weight at the left-hand square thread approach neutral to prevent thread locking or frictional binding. Rig time is often wasted attempting to approach the neutral point, and establishing the neutral point in horizontal wells can become increasingly difficult due to work string-to-casing torque and drag problems. Thus, a need exists to eliminate having to find the neutral point to disengage the left-hand square thread.

SUMMARY OF THE INVENTION

The present invention provides a mechanical lock on the setting sleeve which prevents premature setting of the gravel pack packer even during severe work string and tool manipulations through the well hole. The present invention also provides a rotational lock which locks the gravel pack tool rotationally to the service tool assembly to permit rotation of the gravel pack tool to facilitate the passing of tight spots in the well hole. The present invention also provides for easy deactivation of both locks by the creation of a pressure differential between the inside and outside of the setting tool. No manipulation of the work string is needed to deactivate the locks.

One aspect of the present invention provides a multiple acting lock for a gravel pack system. The multiple acting lock comprises a setting sleeve having a first end in operative engagement with the setting piston and a second end in operative engagement with the packer. There is at least one recess on the inner surface of the setting sleeve. A no-go sleeve is provided which is disposed concentrically inside the setting sleeve and has one end longitudinally fixed on the setting tool and a second end rotationally engaged with the gravel pack tool. The no-go sleeve also has at least one hole through its sidewall in communication with the recess in the setting sleeve. A locking cylinder is concentrically disposed inside the no-go sleeve and is hydraulically movable from a locked position to an unlocked position. Keys are disposed through the holes and extend into the recess to longitudinally lock the setting sleeve when the locking cylinder is in the locked position. A locking end on the locking cylinder rotationally locks the no-go sleeve to the setting tool when the locking cylinder is in the locked position. When the locking cylinder is in the unlocked position the keys are movable out of the recess to unlock the setting sleeve and the locking end moves to allow the setting tool to rotate independently from the no-go sleeve.

Another aspect of the present invention is a setting tool for series connection between the end of a work string and a cross-over tool. The setting tool of the present invention has a locking mechanism which is maintained in a locked position during tripping of the gravel pack tool. The lock also allows transmission of work string rotation to the gravel pack tool. Also, when in the locked position, the setting sleeve of the packer of the gravel pack tool is locked from longitudinal movement thereby preventing any premature setting of the packer caused by friction between a tight spot in the casing and the setting sleeve.

When the gravel pack tool has been set in its desired position in the well hole, the locking mechanism is then unlocked which allows the setting sleeve of the packer to move downward and set the packer in place. Unlocking also removes the rotational engagement of the service tool assembly with the gravel pack tool. Disengagement of the rotational lock allows, in the case where the service tool assembly is attached by left-hand threads to the gravel pack tool, the rotation of the service tool assembly out of engagement with the gravel pack tool.

The setting tool comprises a mandrel string and a piston sleeve attached to the mandrel string which houses an annular piston hydraulically movable down the mandrel string. A skirt is attached to the piston which extends downward and is engageable with the setting sleeve of the packer. A no-go sleeve, having one or more holes, is concentrically disposed inside the setting sleeve and is longitudinally fixed to the mandrel string at its top and is rotationally engaged with the gravel pack tool at its bottom. Keys are disposed in each hole and are engageable with the setting sleeve so as to prevent longitudinal movement of the setting sleeve. A locking cylinder is concentrically disposed between the no-go sleeve and the mandrel string and is hydraulically movable down the mandrel string from a locked position, wherein the locking end of the locking cylinder rotationally locks the mandrel string with the no-go sleeve and the keys are retained in engagement with the setting sleeve; and an unlocked position, wherein the mandrel string can rotate independently of the no-go sleeve and the keys are movable inward out of engagement with the setting sleeve when the setting piston moves downward.

Another aspect of the present invention comprises a bearing assembly between a shoulder of the mandrel string and the top of the no-go sleeve so that when the mandrel string is out of rotational lock with the no-go sleeve, rotation of the work string occurs at the bearings and no load is transferred at the left-hand threads thereby eliminating the need to reach a neutral point of work string load on the left-hand threads.

BRIEF DESCRIPTION OF THE DRAWINGS

For a more complete understanding of the present invention and for further advantages, reference is now made to the following description of the preferred embodiment taken in conjunction with the accompanying drawings, in which.

DETAILED DESCRIPTION OF THE PREFERRED EMBODIMENT

Figure 1:
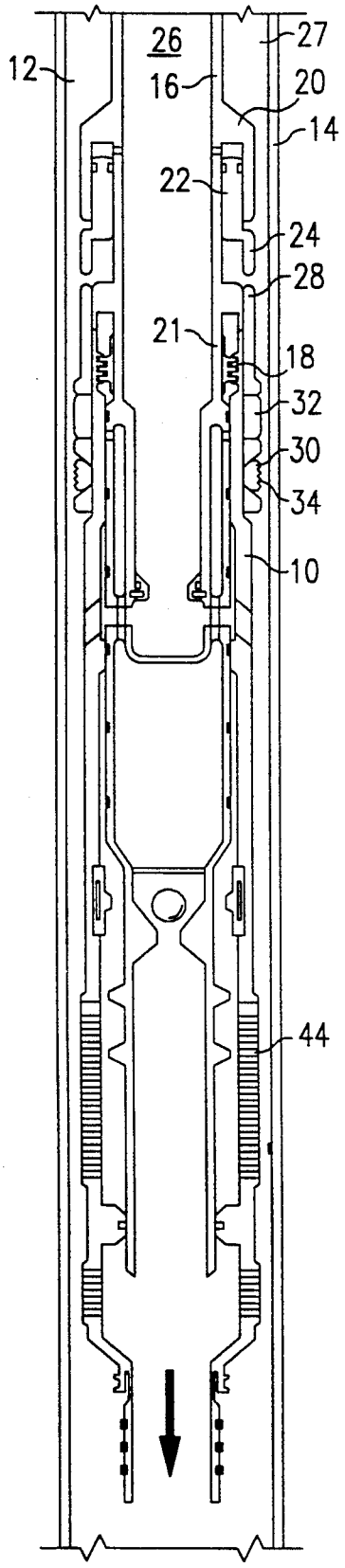
FIG. 1 (PRIOR ART)
FIG. 1 is a longitudinal sectional diagram of a conventional gravel pack system tool being tripped down a well hole.
Figure 2:
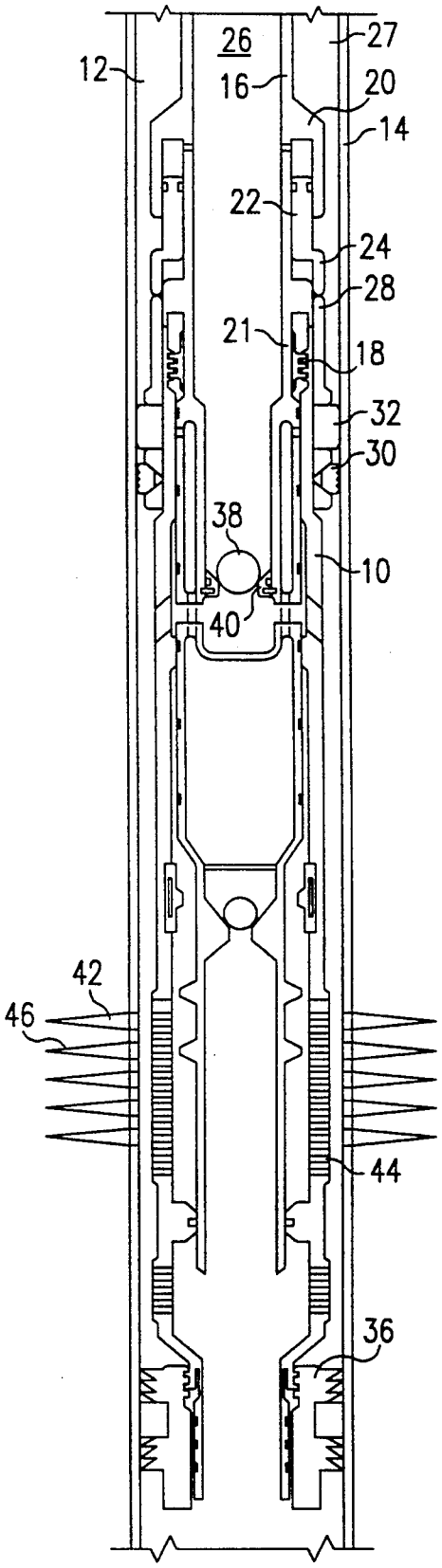
FIG. 2 (PRIOR ART)
FIG. 2 is a longitudinal sectional diagram of a conventional gravel pack system being set in a well hole.

FIGS. 1 and 2 depict a conventional gravel pack system which typically comprises a service tool assembly used to trip and set a gravel pack tool in a well hole. With reference to FIG. 1 gravel pack tool 10 is being lowered, or "tripped", down well hole 12 which is lined by casing 14. Gravel pack tool 10 rides down on service tool assembly 16. Gravel pack tool 10 can be engaged with service tool assembly 16 at left-hand square thread 18. Service tool assembly 16 typically comprises setting tool 20 and cross-over tool 21. Setting tool 20 houses annular setting piston 22 which is connected to skirt 24. During the tripping of gravel pack tool 10, setting sleeve 28 or some intermediate sleeve, not shown, between it and packer 30 is typically secured by shear screws from longitudinal movement. Skirt 24 can also be secured by shear screws. Setting sleeve 28 is proximate packer 30 which has elastomeric seal 32 and slips which ar shown as teeth 34.

With reference to FIG. 2 the bottom of gravel pack tool 10 is latched into sump packer 36 and packer 30 is set into casing 14. Packer 30 is set by applying hydraulic pressure in tubing chamber 26 which drives hydraulic setting piston 22 downward, shearing any shear screws preventing longitudinal movement of setting sleeve 28, and pushing setting sleeve 28 down on packer 30 which sets packer 30 by extending teeth 34 which bite into the side of casing 14. Ball 38 is dropped onto seat 40 to allow the buildup of the hydraulic pressure in tubing chamber 26. While the just described setting operation was achieved by tubing chamber 26 to annulus chamber 27 pressure differential, the setting tool can have ports above the setting piston that communicate with annulus chamber 27 so that the setting operation can be achieved by pressuring the annulus chamber 27.

After packer 30 has been set, gravel screen 44 of gravel pack tool 10 is ready to be packed with gravel in preparation for producing oil from producing zone 42. Gravel pack tool 10 is positioned such that gravel screen 44 is proximate fractures 46 in producing zone 42. Sump packer 36 and packer 30 serve to confine producing zone 42 by sealing casing 14 above and below the producing zone to prevent migration of oil to other zones or geological formations.

To gravel pack gravel screen 44, the service tool assembly is disengaged from the gravel pack tool and moved up and down inside the gravel pack tool to various positions. If left-hand square thread 18 is used to join the gravel pack tool to the service tool assembly as shown in FIGS. 1 and 2, then disengagement involves rotating the tubing string so that the service tool assembly rotates out of the left-hand square thread connection. The cross-over tool component of the service tool assembly is used to deliver and "squeeze" gravel around screen 44.

One aspect of the present invention provides a multiple acting lock which, during tripping, prevents premature setting of the packer of a gravel pack tool and allows rotation of the gravel pack tool, and after tripping, is easily "unlocked" to allow setting of the packer and rotation of the service tool assembly relative to the gravel pack tool. Another aspect of the present invention is a complete locking setting tool which is attachable to a cross-over tool for use in the service tool assembly. The locking setting tool of the present invention has a locking mechanism which, during tripping, prevents premature setting of the packer of a gravel pack tool and allows rotation of the gravel pack tool, and after tripping, is easily "unlocked" to allow setting of the packer and rotation of the service tool assembly relative to the gravel pack tool. Upon application of hydraulic pressure in tubing chamber 26, the present invention will unlock allowing the setting sleeve to move to set the packer and allow rotation of the service tool assembly out of engagement with the gravel pack tool.

With reference to FIGS. 3, 4A, 4B and 5, the preferred embodiment of the multiple acting lock and the locking setting tool of the present invention are further described. Locking setting tool 20 comprises a mandrel string 47 which can comprise top sub 48, upper mandrel 52, coupling 66 and lower mandrel 68. Top sub 48 attaches to the work string, not shown, at threads 50. Suspended from top sub 48 is upper mandrel 52 which is threaded into the inside of top sub 48 at threads 49. Also suspended from top sub 48 is piston sleeve 54 attached at threads 55 around the outside of top sub 48. This arrangement creates piston chamber 56 which can communicate with tubing chamber 26 by port 60. In an alternative embodiment, piston chamber 56 can, instead, communicate with the annulus chamber by a port through piston sleeve 54. Disposed within piston chamber 56 is annular setting piston 22 with piston surface 57. Circular seals 62 on the inside and outside circumference of annular setting piston 22 seal annular chamber 56. Skirt 24 is attached to annular setting piston 22 at threads 64. Coupling 66 joins upper mandrel 52 with lower mandrel 68 at threaded connections 67 and 69. Coupling 66 is of such dimension that skirt 24 can extend over coupling 66.

Longitudinally engaged with lower mandrel 68 is no-go sleeve 70. No-go sleeve 70 has first no-go sleeve end 71 fixed to the mandrel string and second no-go sleeve end 73 rotationally locked with the top of gravel pack tool 10. First no-go sleeve end 71 has radially inward step 72 which extends over and engages with shoulder 74 on lower mandrel 68. This positive engagement prevents any longitudinal movement of no-go sleeve 70 relative to lower mandrel 68. On top surface 76 of no-go sleeve 70 is bearing race 78 which contains bearings 80. On bottom surface 82 of coupling 66 is corresponding bearing race 84 riding on bearings 80. Bearing races 78 and 84 and bearings 80 allow for rotation of coupling 66 relative to no-go sleeve 70. Thus, rotation of the work string, not shown, will rotate mandrel string 47 independently of no-go sleeve 70 when no-go sleeve 70 is not in rotational lock with lower mandrel 68.

Figure 3:
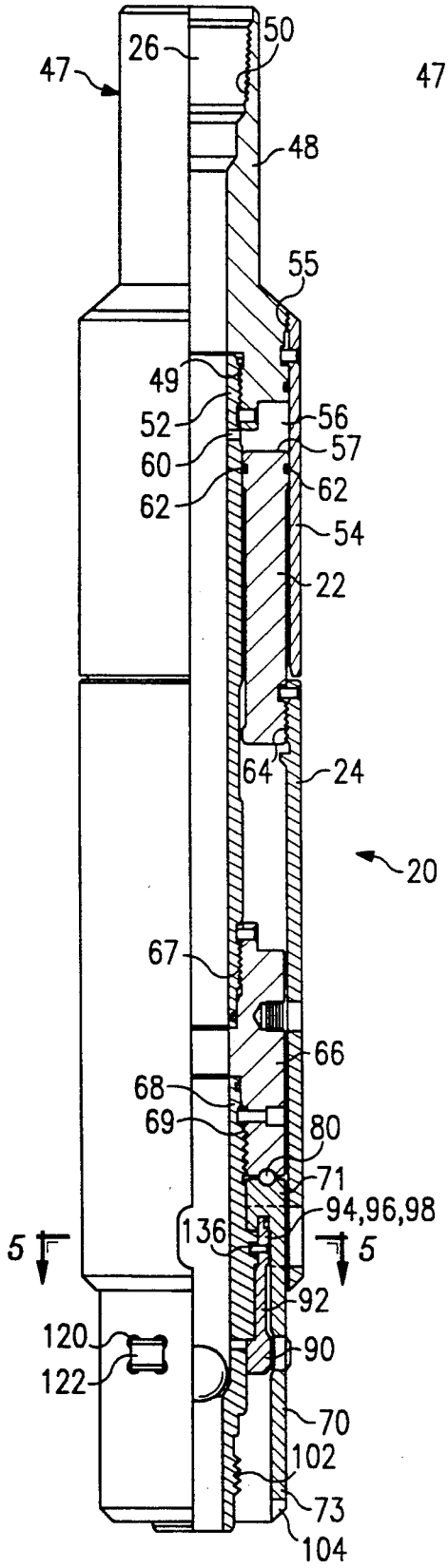
FIG. 3 is a quarter section of the preferred embodiment of the setting tool of the present invention.
Figure 4A:
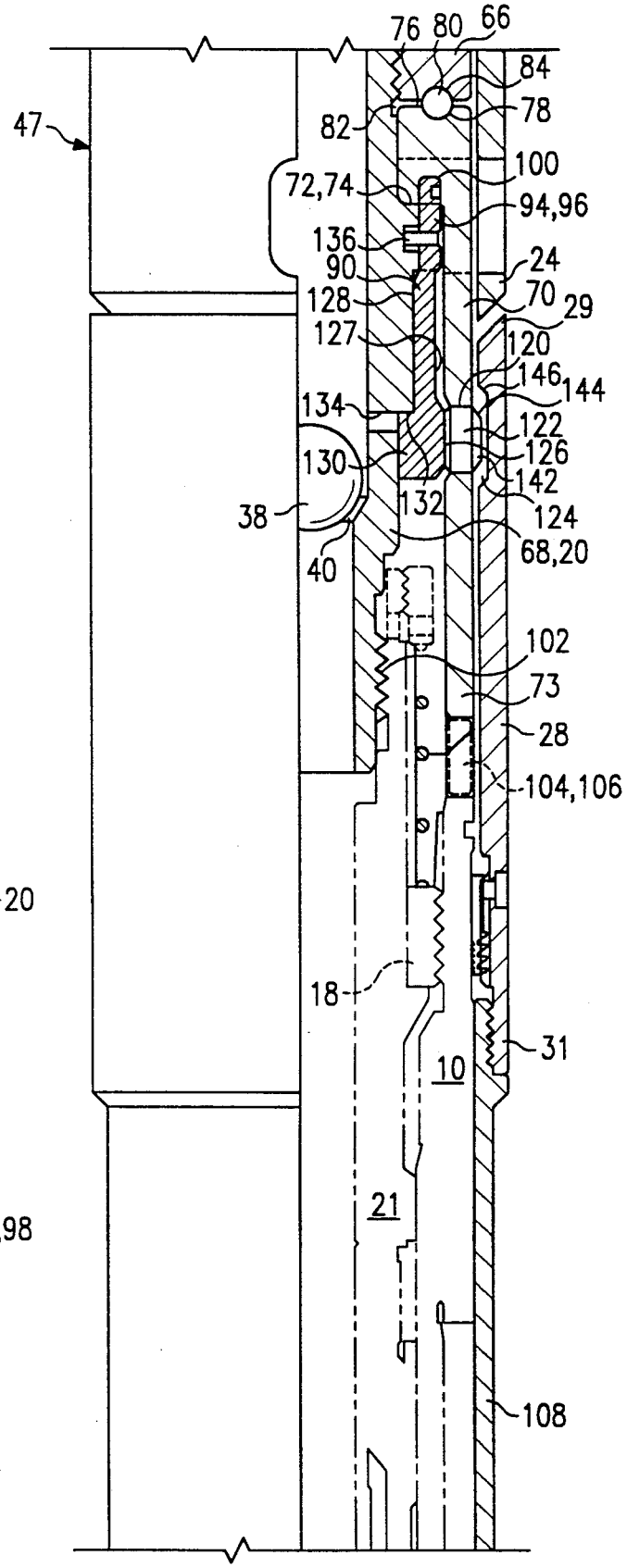
FIG. 4A is a quarter section illustrating the preferred embodiment of the multiple acting lock of the present invention in the locked position.

With reference to FIGS. 3 and 4A, locking cylinder 90 is shown in the locked position. Locking cylinder 90 serves to lock no-go sleeve 70 rotationally with lower mandrel 68. Locking cylinder 90 has cylindrical portion 92 slidably disposed over lower mandrel 68. Attached to cylindrical portion 92 is a plurality of projections 94 which extend through longitudinal channels 96 in shoulder 74 of lower mandrel 68. Longitudinal channels 96 are dimensioned to receive and rotationally lock with projections 94. Projections 94 further extend into slots 100 in the underside of radially inward step 72. Slots 100 communicate with longitudinal channels 96 and are dimensioned to receive and rotationally lock with projections 94. In this locked position, work string rotation is transmitted to no-go sleeve 70. When locking cylinder 90 is in the locked position as shown in FIGS. 3 and 4A, rotation of the work string is transmitted to locking cylinder 90 by channels 96 of shoulder 74 acting on projections 94 of locking cylinder 90. Rotation is then transmitted from the tops of projections 94 to slots 100 in radially inward step 72.

Figure 5:
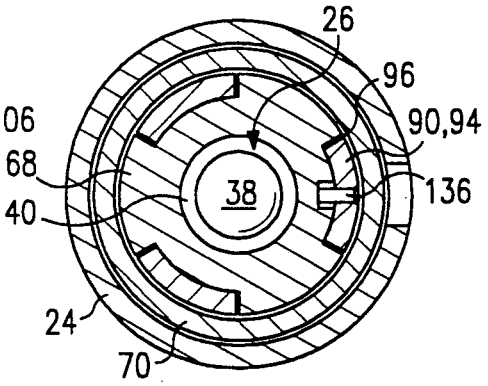
FIG. 5 is a cross-section along lines 5—5 of FIG. 3 showing the preferred arrangement of the rotational locking mechanism of the present invention.

With reference to FIG. 5 the relationship of locking cylinder 90 with lower mandrel 68 and no-go sleeve 70 is shown in further detail. FIG. 5 is a section across 5—5 of FIG. 3. Projections 94 of locking cylinder 90 are disposed within channels 96 of shoulder 74 of lower mandrel 68. At this point in the section no-go sleeve 70 is disposed around lower mandrel 68 and projections 94. Skirt 24 is disposed around no-go sleeve 70 in this section. It should be understood that any number of projections 94, channels 96 and slots 100 can be used to rotationally lock lower mandrel 68 to no-go sleeve 70. Also, any configuration of projections 94, channels 86 and slots 100 can be used as long as no-go sleeve 70 is locked into rotation with mandrel string 47.

Figure 4B:
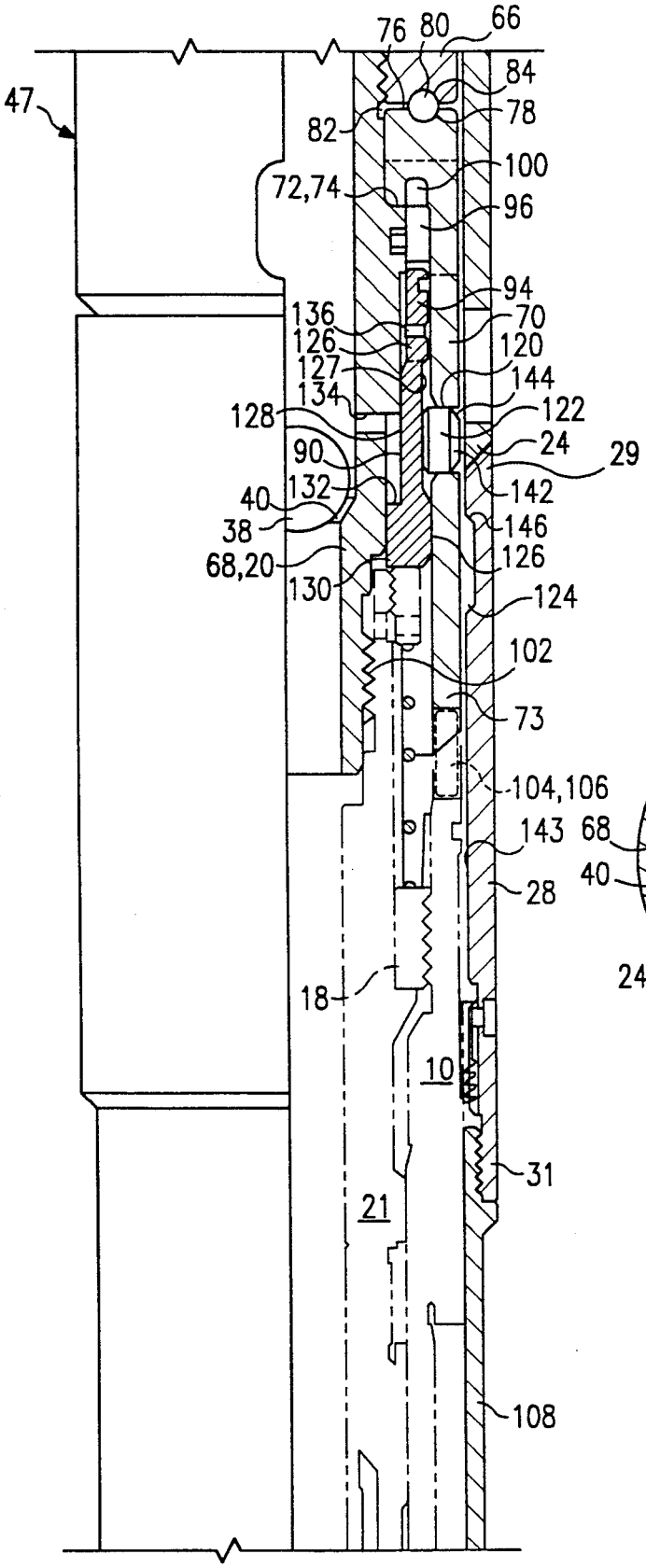
FIG. 4B is a quarter section illustrating the preferred embodiment of the multiple acting lock of the present invention in the unlocked position.

With reference to FIGS. 4A and 4B the relationship of the preferred embodiment of the multiple acting lock and of locking setting tool 20 of the present invention with cross-over tool 21 and gravel pack tool 10 will be further described. A cross-over tool 21 is connected to setting tool 20 by threads 102. Threads 102 are on the outside of the lower portion of lower mandrel 68 of setting tool 20. Gravel pack tool 10 is mounted on cross-over tool 21 at left-hand square thread 18. Thus, gravel pack tool 10, during tripping, is connected to cross-over tool 21 at left-hand square thread 18 and cross-over tool 21 is connected to lower mandrel 68 of setting tool 20 at threads 102. To lock gravel pack tool 10 in rotation with the work string locking cylinder 90 locks mandrel string 47 to no-go sleeve 70 with projections 94 and no-go sleeve 70 is locked to gravel pack tool 10 by tongues 104 at second no-go sleeve end 73 which mesh with corresponding grooves 106 at the top of gravel pack tool 10.

Setting sleeve 28 has first setting sleeve end 29 in operative engagement with skirt 24 of setting piston 22 and has second setting sleeve end 31 attached to packer sleeve 108 of packer 30. When gravel pack tool 10 is mounted to cross-over tool 21, setting sleeve 28 extends up and around no-go sleeve 70 of setting tool 20. Shear screws can be used to retain setting sleeve 28 and/or packer sleeve 108 in place on gravel pack tool 10. No-go sleeve 70 has a plurality of holes 120. Keys 122 are disposed within holes 120. Keys 122 are wider than the wall thickness of no-go sleeve 70. Lock side 142 of keys 122 protrudes outward into recess 124 on inner surface 143 of setting sleeve 28. Keys 122 are retained in holes 120 by the position of locking cylinder 90 which has first radial ridge 126 on its outside surface 127 which is flush with and covers holes 120 of no-go sleeve 70 which keeps lock side 142 of key 122 protruding into recess 124 when locking cylinder 90 is in the locked position. The protrusion of key 122 into recess 124 of setting sleeve 28 prevents movement of setting sleeve 28 thus preventing premature setting of the packer. Recess 124 of inner surface 143 of setting sleeve 28 can be a continuous radial recess or noncontinuous as long as it communicates with holes 120.

The top of lock side 142 of keys 122 has downward slope 144. The top of recess 124 has inclined side 146. When first radial ridge 126 is moved away from holes 120 and setting sleeve 28 begins to move downward, inclined side 146 will contact downward slope 144 pushing key 122 inward through hole 120 until inclined side 146 is free to pass by lock side 142. Any configuration of keys 120 and recess 124 can be used as long as setting sleeve 28 is locked from longitudinal movement.

If a tight spot or a tight curve is encountered as gravel pack tool 10 is being tripped down the hole on the service tool assembly, the work string can be reciprocated and/or rotated to force the tool through the tight spot. The present invention prevents setting sleeve 28 from sliding against packer 30 by keys 122.

When the work string needs to be rotated to maneuver past a tight spot, rotation does not act on left-hand square thread 18 due to engagement of tongues 104 with grooves 106 and the locking of no-go sleeve 70 to lower mandrel 68. Rotation is transferred from the work string to the gravel pack tool through no-go sleeve 70 which is rotationally engaged at first no-go sleeve end 71 to the work string and second no-go sleeve end 73 to gravel pack tool 10.

When gravel pack tool 10 is bottomed into sump packer 36, packer 30 may then be set. This is performed by dropping ball 38 onto seat 40. Tubing chamber 26 is then pressurized. On the inside surface 128 of locking cylinder 90, towards the bottom, is a second radial ridge 130 which has upper surface 132. Upper surface 132 is proximate port 134 which communicates with tubing chamber 26. Hydraulic pressure in tubing chamber 26 acts upon upper surface 132. During tripping, locking cylinder 90 is retained in place by a fastener which in the preferred embodiment is shown as shear screws 136. As the hydraulic acting on upper surface 132 increases, the shear strength of shear screws 136 is eventually overcome. This allows the hydraulic pressure to force locking cylinder 90 downward. Shear screws 136, or any other fastener which retains locking cylinder 90 in the locked position, are not affected by manipulation of the work string because no-go sleeve 70, which is fixed to lower mandrel 68, shields locking cylinder 90 from any friction or tight spots encountered in the well hole.

With reference to FIG. 4B, when locking cylinder 90 moves downward, first radial ridge 126 slides out of relationship with keys 122 allowing keys 122 to be pushed inward through holes 120 by inclined side 146 and out of recess 124. Once keys 122 have moved out of recess 124, setting sleeve 28 is free to move downward. As the hydraulic pressure continues to increase, any shear screws retaining skirt 24 and/or packer sleeve 108 are sheared and setting piston 22 moves downward pressing skirt 24 against setting sleeve 28 which sets packer 30. In the preferred embodiment the shear screws retaining packer sleeve 108 shear at a higher strength than shear screws 136 retaining lock cylinder 90. This allows for a complete deactivation of the locking mechanism before packer 30 is set. Thus, at one predetermined level of hydraulic pressure in tubing chamber 26, locking cylinder 90 will slide down disengaging the setting sleeve lock and the rotational lock, and at a second higher predetermined level of hydraulic pressure annular setting piston 22 will set packer 30. The predetermined levels are a function of shear screws 136 and the shear screws on packer sleeve 108. In the preferred embodiment one pressurization of tubing chamber 26 will deactivate the multiple acting lock and set the packer. However, two different pressurization steps could be used. Also, while the multiple acting lock may be deactivated by tubing pressure the setting piston may be set by pressurizing the annulus or vice versa.

At the same time that locking cylinder 90 moves downward to allow keys 122 to move and unlock setting sleeve 28, projections 94 are moved out of slots 100 in no-go sleeve 70. This removes the rotational lock of lower mandrel 68 with no-go sleeve 70 and thus the work string, mandrel string and cross-over tool can be rotated independently of no-go sleeve 70 and gravel pack tool 10. Thus as the work string is rotated, no rotation will be transferred to the no-go sleeve. Since no rotation is being transferred to no-go sleeve 70, no rotation is being transferred through tongues 104 and grooves 106 to gravel pack tool 10. Thus, as the work string is rotated after the rotational lock is disengaged, left-hand square thread 18 will become disengaged and the service tool assembly will be able to be moved relative to gravel pack tool 10. Since tongues 104 and grooves 106 are only in a rotational lock, they will not inhibit pulling up of the service tool assembly. No-go sleeve 70 will be moved longitudinally with setting tool 20 due to being longitudinally fixed at radially inward step 72 with shoulder 74.

After locking cylinder 90 has been unlocked to take lower mandrel 68 out of rotation relation to no-go sleeve 70, the work string can be supported on bearings 80 as it is rotated since female coupling 66 rotates on bearings 80 relative to no-go sleeve 70. Bearings 80 allow relatively effortless disengagement of the left-hand square threads since all work string load is on bearings 80 which take the load off the left-hand square threads.

In certain well applications it may be futile to attempt rotation of the work string such as in horizontal drilling situations. In such a case the service tool assembly can be connected to the gravel pack tool with a shear ring in place of the left-hand square threads. In this application the bearings 80 would be optional. When the gravel pack tool was in place, the service tool assembly would be disengaged by a straight pull on the work string to shear the shear ring.

Although the present invention has been described with respect to a specific preferred embodiment thereof, various changes and modifications may be suggested to one skilled in the art, and it is intended that the present invention encompass such changes and modifications as fall within the scope of the appended claims.

We claim:

1. A multiple acting lock for a gravel pack system, comprising:

(a) a setting sleeve having a first setting sleeve end in operative engagement with a setting piston of a setting tool, a second setting sleeve end in operative engagement with a packer of a gravel pack tool, and an inner surface with at least one recess;

(b) a no-go sleeve disposed concentrically inside said setting sleeve and having a first no-go sleeve end longitudinally fixed on the setting tool, a second no-go sleeve end rotationally engaged with the gravel pack tool, and at least one hole through the side of said no-go sleeve in communication with said at least one recess;

(c) a locking cylinder concentrically disposed inside said no-go sleeve which is hydraulically movable from a locked position to an unlocked position; and (d) at least one key disposed in said at least one hole that extends into said at least one recess and longitudinally locks said setting sleeve when said locking cylinder is in the locked position, and, when said locking cylinder is in the unlocked position, said at least one key is movable out of said at least one recess by longitudinal movement of said setting sleeve.

2. The multiple acting lock of claim 1 wherein said locking cylinder further comprises a locking end that rotationally locks said no-go sleeve to the setting tool when said locking cylinder is in the locked position and, when said locking cylinder is in the unlocked position, said locking end moves so that the setting tool can rotate relative to said no-go sleeve.

3. The multiple acting lock of claim 2 wherein said locking cylinder further comprises an inside surface, an outside surface and a first radial ridge on said outside surface that covers said at least one hole to retain said at least one key extending into said at least one recess when said locking cylinder is in the locked position, and, when the locking cylinder is in the unlocked position, said first radial ridge moves away from said at least one hole.

4. The multiple acting lock of claim 3 wherein said locking cylinder further comprises a second radial ridge having an upper surface hydraulically actable upon by a pressure differential between the inside and outside of the setting tool.

5. The multiple acting lock of claim 4 further comprising at least one fastener connecting said locking cylinder to the setting tool and of a strength such that when the pressure differential is less than a predetermined amount, said at least one fastener retains said locking cylinder so that said locking end rotationally connects the setting tool to said no-go sleeve and said first radial ridge covers said at least one hole so that said at least one key extends into said at least one recess; and such that when the pressure differential reaches the predetermined amount, said at least one fastener releases and said locking cylinder is moved down which rotationally disconnects the setting tool from said no-go sleeve and moves said first radial ridge away from said at least one hole allowing said at least one key to be pushed out of said at least one recess.

6. The multiple acting lock of claim 5 wherein said second radial ridge is on said inside surface of said locking cylinder and said upper surface is actable upon by pressurization of the inside of the setting tool.

7. The multiple acting lock of claim 6 wherein the pressurization of the inside of the setting tool which acts upon said upper surface will also move the setting piston of the setting tool.

8. The multiple acting lock of claim I wherein said at least one key has a lock side with a downward slope which extends into engagement with said setting sleeve.

9. The multiple acting lock of claim 2 wherein said locking end further comprises at least one projection extending from said locking end of said locking cylinder such that when said locking cylinder is in the locked position said at least one projection rotationally engages with said no-go sleeve and the setting tool.

10. The multiple acting lock of claim 9 wherein said no-go sleeve further comprises a radially inward step at said first no-go sleeve end which is longitudinally fixed on the setting tool.

11. The multiple acting lock of claim 9 wherein said radially inward step has at least one slot in its underside which receives said at least one projection.

12. The multiple acting lock of claim 1 further comprising:

(a) a bearing block fixed to the setting tool above the said first no-go sleeve end; and (b) a bearing means located between the bottom of said bearing block and said first no-go sleeve end to bear thrust forces during rotation of the setting tool relative to said no-go sleeve when said locking cylinder is in the unlocked position.

13. A multiple acting lock for a gravel pack system, comprising:

(a) a setting sleeve having a first setting sleeve end in operative engagement with a setting piston of a setting tool, a second setting sleeve end in operative engagement with a packer of a gravel pack tool, and an inner surface with at least one recess;

(b) a no-go sleeve disposed concentrically inside said setting sleeve and having a first no-go sleeve end longitudinally fixed on the setting tool, a second no-go sleeve end rotationally engaged with the gravel pack tool, and at least one hole through the side of said no-go sleeve in communication with said at least one recess;

(c) a locking cylinder concentrically disposed inside said no-go sleeve which is hydraulically movable from a locked position to an unlocked position; and (d) a locking end on said locking cylinder that rotationally locks said no-go sleeve to the setting tool when said locking cylinder is in the locked position and, when said locking cylinder is in the unlocked position, said locking end move so that the setting tool can rotate relative to said no-go sleeve.

14. The multiple acting lock of claim 13 wherein said locking end further comprises at least one projection extending from said locking end of said locking cylinder such that when said locking cylinder is in the locked position said at least one projection rotationally engages with said no-go sleeve and the setting tool.

15. A multiple acting lock for a gravel pack system, comprising:

(a) a setting sleeve having a first setting sleeve end in operative engagement with a setting piston of a setting tool, a second setting sleeve end in operative engagement with a packer of a gravel pack tool, and an inner surface with at least one recess;

(b) a no-go sleeve disposed concentrically inside said setting sleeve and having a first no-go sleeve end longitudinally fixed on the setting tool, a second no-go sleeve end rotationally engaged with the gravel pack tool, and at least one hole through the side of said no-go sleeve in communication with said at least one recess;

(c) at least one key, wider than the depth of said at least one hole, disposed in said at least one hole;

(d) a locking cylinder concentrically disposed inside said no-go sleeve and having a locking end, an outside surface, an inside surface, a first radial ridge on said outside surface, and a second radial ridge on said inside surface that slidably seals around the outside diameter of the setting tool, said second radial ridge having an upper surface hydraulically actable upon by a pressure differential between the inside and outside of the setting tool;

(e) at least one fastener connecting said locking cylinder to the setting tool and of a strength such that when the pressure differential is less than a predetermined amount, said at least one fastener retains said locking cylinder so that said locking end rotationally connects the setting tool to said no-go sleeve and said first radial ridge covers said at least one hole so that said at least one key extends into said at least one recess; and such that when the pressure differential reaches the predetermined amount, said at least one fastener releases and said locking cylinder is moved down which rotationally disconnects the setting tool from said no-go sleeve and moves said first radial ridge away from said at least one hole allowing said at least one key to be pushed inwardly out of said at least one recess.

16. A setting tool for a gravel pack system, comprising:

(a) a mandrel string connectable between a work string and a cross-over tool;

(b) a piston sleeve concentrically attached to said mandrel string;

(c) an annular setting piston housed in said piston sleeve and hydraulically movable down said mandrel string;

(d) a skirt attached to said setting piston extending downward and engageable with a setting sleeve of a packer on a gravel pack tool;

(e) a no-go sleeve having at least one hole in its sidewall, a first no-go sleeve end longitudinally fixed to said mandrel string below said setting piston, and a second no-go sleeve end rotationally engaged with the gravel pack tool;

(f) at least one key, wider than the depth of said at least one hole, disposed in said at least one hole such that is engageable with the setting sleeve so as to prevent longitudinal movement of the setting sleeve; and (g) a locking cylinder having a locking end, an outside surface, an inside surface, a first radial ridge on said outside surface, and a second radial ridge on said inside surface, said second radial ridge having an upper surface; said locking cylinder slidably disposed between said mandrel string and said no-go sleeve such that said second radial ridge seals around the outside diameter of said mandrel string which has a port through its sidewall proximate said upper surface; said locking cylinder hydraulically movable down said mandrel assembly from a locked position, wherein said locking end of said locking cylinder rotationally connects said no-go sleeve to said mandrel string and said first radial ridge covers said at least one hole keeping said at least one key in engagement with the setting sleeve; and an unlocked position, wherein said mandrel assembly can rotate independently of said no-go sleeve and said at least one key is movable inwardly out of engagement with the setting sleeve.

17. The setting tool of claim 16 further comprising:

(a) a bearing block located on said mandrel string above said first no-go sleeve end; and (b) a bearing means located between said bearing block and said first no-go sleeve end to bear thrust forces during rotation of said mandrel string relative to said no-go sleeve when said locking cylinder is in the unlocked position.

18. The setting tool of claim 16 wherein said at least one key has a lock side with a downward slope Which can extend into engagement with a recess in the setting sleeve.

19. The setting tool of claim 16 further comprising a plurality of projections extending from said locking end of said locking cylinder such that when said locking cylinder is in the locked position said projections rotationally engage with said mandrel string and said no-go sleeve.

20. The setting tool of claim 19 wherein said mandrel string further comprises a shoulder having at least one longitudinal channel which receives said at least one projection.

21. The setting tool of claim 20 wherein said no-go sleeve further comprises a radially inward step at said first no-go sleeve end which positively engages on top of said shoulder.

22. The setting tool of claim 21 wherein said radially inward step has at least one slot in its underside which communicates with at least one channel and dimensioned to receive said at least one projection.

23. The setting tool of claim 16 wherein one act of pressurization of the inside of said mandrel string will move said locking cylinder to the unlocked position and move said annular setting piston down said mandrel string.

* * * * *